United States Patent [19]

Harris

[11] Patent Number: 4,742,775

[45] Date of Patent: May 10, 1988

[54] POWER LOAD FOR UNDERWATER SPEAR GUN

[76] Inventor: Paul C. Harris, 8717-191st Pl. SW., Edmonds, Wash. 98020

[21] Appl. No.: 936,510

[22] Filed: Dec. 1, 1986

Related U.S. Application Data

[63] Continuation-in-part of Ser. No. 731,046, May 6, 1985, Pat. No. 4,651,454.

[51] Int. Cl.[4] ..... F41C 9/06; F42B 7/00

[52] U.S. Cl. ..... 102/456; 102/462; 102/430; 42/1.14; 206/811

[58] Field of Search ..... 102/530, 531, 464, 465, 102/466, 468, 462, 456, 430; 206/811

[56] References Cited

U.S. PATENT DOCUMENTS

| | | | |
|---|---|---|---|
| D. 262,478 | 12/1981 | Beuchat | D22/1 |
| 356,876 | 6/1862 | Johnston | 102/464 |
| 1,144,379 | 6/1915 | Pritham | 102/464 |
| 1,196,200 | 8/1916 | Batcher | 102/462 |
| 2,591,286 | 4/1952 | Paulve | 102/462 |
| 2,725,048 | 11/1955 | Koogle | 124/11 |
| 3,067,454 | 12/1962 | Catlin et al. | 17/1 |
| 3,516,358 | 6/1970 | Manninen | 102/49.1 |
| 3,585,934 | 6/1971 | Mueller | 102/48 |
| 3,585,979 | 6/1971 | Hendricks | 124/22 R |
| 3,616,561 | 11/1971 | Hendricks | 42/1.14 |
| 3,780,720 | 12/1973 | Alderson | 124/11 A |
| 3,838,532 | 10/1974 | Prodanovich | 42/1.14 |
| 3,871,120 | 3/1975 | Mounier | 42/1.14 |
| 4,019,480 | 4/1977 | Kenaio | 124/61 |
| 4,193,386 | 3/1980 | Rossi | 124/22 |
| 4,359,999 | 11/1982 | Garofalo | 124/80 |

*Primary Examiner*—Deborah L. Kyle
*Assistant Examiner*—Michael J. Carone
*Attorney, Agent, or Firm*—Gary T. Hampson

[57] ABSTRACT

A power load for use with an underwater spear gun including a casing, explosive material within the casing, the casing having one closed end adapted to open when the explosive material explodes. The closed end is sealed with a sealing compound to prevent water from penetrating the casing. The closed end may be crimped closed or closed by means of a wad or plug of suitable material. The sealing compound may be a silicone rubber or polylvinylchloride which permeates the closed end.

2 Claims, 3 Drawing Sheets

POWER LOAD FOR UNDERWATER SPEAR GUN

This application is a continuation in part of copending U.S. patent application Ser. No. 731,046, filed May 6, 1985, in the name of Paul C. Harris, now U.S. Pat. No. 4,651,454.

FIELD

The present invention is directed to the field of underwater diving equipment and more particularly to a power load for use with an underwater spear gun.

BACKGROUND

Several types of spear guns are known for use underwater and may generally be catagorized by the type of propulsion employed for the spear. For example, one type of gun uses one or more elastic cords fixed near the tip of the gun. The cords are stretched and hooked to a spear carried by the gun. When the spear is released, the elastic cords rapidly contract and propel the spear. Another type of gun is an air powered gun which uses compressed air to force a piston down a smooth barrel. A spear resting within the barrel is propelled by the piston as the piston travels down the barrel.

Another type of gun uses a conventional firearm cartridge to propel a spear. One such gun uses a .38 caliber firearm cartridge including a projectile and a primer in one end of the cartridge to ignite the gun powder therein. Other examples of a conventional firearm cartridges include a "blank type" firearm cartridge disclosed in U.S. Pat. No. 3,616,561 issued to G. E. Hendricks and a conventional .22 caliber cartridge used to propel a dart into a target as disclosed in U.S. Pat. No. 3,838,532 to Prodanovich. Lastly, so-called "bang sticks" used to repell sharks and the like employ a small waterproof shotgun-like cartridge which expells pellets and a burst of expanding gases toward a shark.

Each of the cartridges just mentioned have distinct drawbacks and disadvantages. The .38 caliber cartridge, the .22 caliber cartridge, and the "bang stick" cartridge each include projectiles which would be damaging to the internal structure of a spear gun. Furthermore, the .38 caliber, .22 caliber, and "blank type" cartridges are not water tight, leading to water saturated powder and the likelihood of misfires and the resulting failure of the spear gun.

SUMMARY OF THE INVENTION

The present invention overcomes the limitations and disadvantages set forth above with previously known cartridges. A power load in accordance with the present invention includes a casing containing an explosive and having an openable end that is adapted to open when the power load is fired. The openable end is coated with a sealing compound such a silicone rubber to provide a waterproof seal. The openable end may be crimped or may be closed by means of a recessed wad or plug.

DETAILED DESCRIPTION

Figure 1:
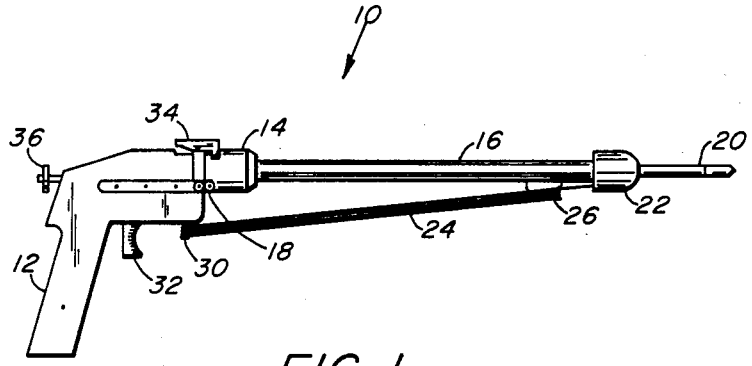
FIG. 1 is a side view of a spear gun for use with the power load of the present invention.

With reference to FIG. 1, a spear gun 10 for use with a power load in accordance with the present invention includes a body 12. A breech 14 and barrel 16 are hinged to the body 12 at a hinge 18. A spear 20 is received within the barrel 16 and a line retainer 22 is carried by the spear. A line 24 is gathered between a hook 26 near the free end of the barrel 16, and a line release 30, part of the body 12. One end of the line 24 is fixed to the line retainer 22 and the other end of the line is fixed to the hook 26. The body 12 includes a trigger 32 and a breech lock 34. The breech lock 34 secures the breech 14 and barrel 16 in a closed position against the body 12. A hammer 36 is carried by the body 12 and is used to cock the gun as is described below. The overall length of the gun 10 including the handle body 12, breech 14, barrel 16, line retainer 22 and spear 20, with the spear 20 received within the barrel 16, may be about eighteen to thirty-six inches.

Figure 2:
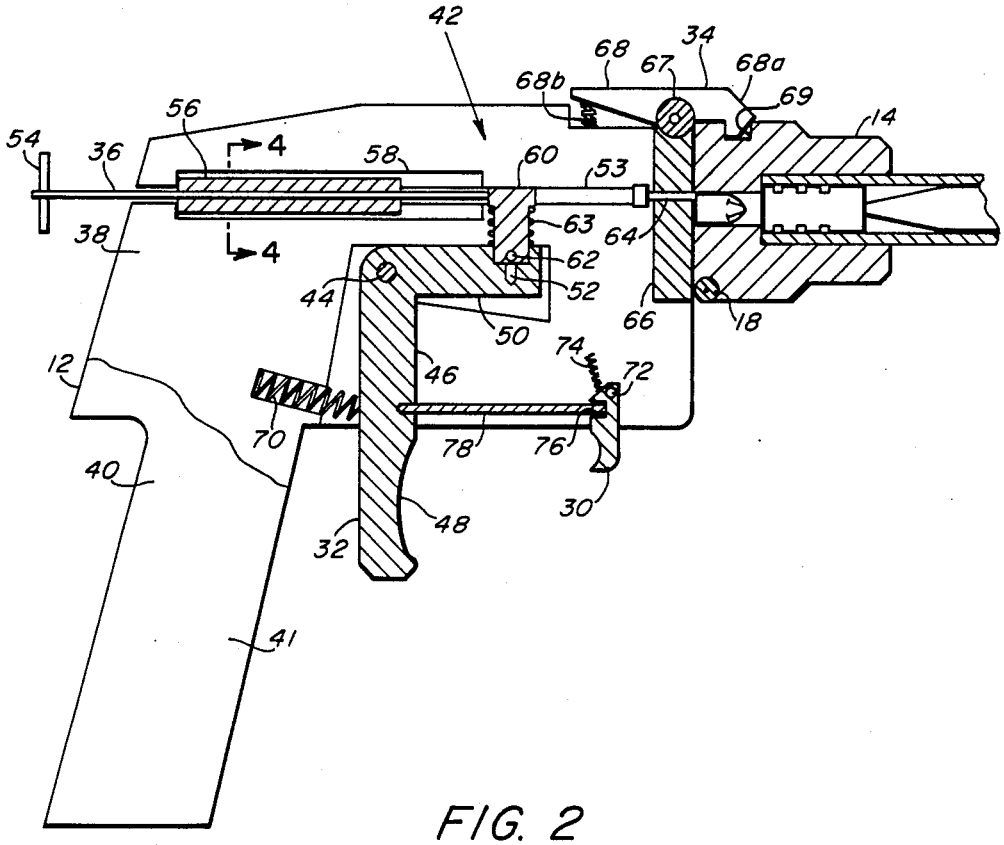
FIG. 2 is a cutaway view of the trigger mechanism of the spear gun of FIG. 1.

With reference to FIG. 2, the body 12 includes a trigger mechanism plate 38 and a cover plate 40. The body 12 is formed to define a grip 41 which may be angled slightly back as shown for ease of use. The grip 41 may include depressions (not shown) adapted to fit the individual fingers of the user as is known in the art. In FIG. 2, the cover plate 40 has been shown partially cutaway to reveal the trigger mechanism shown generally at 42. The trigger mechanism includes the trigger 32 which in greater detail comprises a generally L-shaped member pivoted at a pivot 44. A lower end 46 of the L-shaped member includes an indentation 48 adapted to receive and fit the trigger finger of a user. An upper generally horizontal portion 50 of the L-shaped member includes a vertical slot 52 disposed near the end of the member 50.

Figure 4:
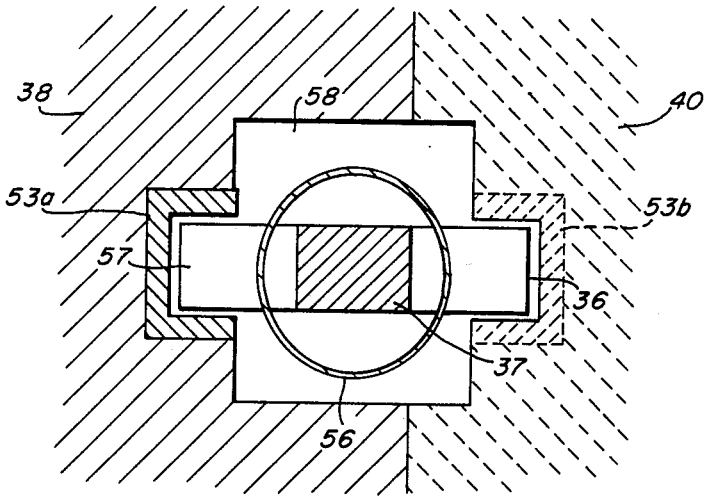
FIG. 4 is a view of the hammer shown partially in cross-section and hammer guide taken along line 4—4 of FIG. 2.

The hammer 36 is carried within a hammer guide 53, the hammer 36 including a bar 54 near the exterior end of the hammer 36 used to pull the hammer 36 into a cocked position. The hammer 36 as seen in FIG. 4 has a generally flat cross section, including a reduced portion 37 about which is disposed a helical spring 56. The spring 56 is received within a recess 58 and the spring 56 transfers its biasing force to a shoulder 57, urging the hammer 36 toward the breech 14 as seen in FIG. 2. The hammer guide 53 includes two U-shaped members **53*a* and 53*b*, the member 53*b* being shown in phantom in FIG. 4 as being part of the cut-away portion of the cover plate 40. A hammer release 60 (FIG. 2) is carried vertically within the trigger mechanism plate 38 and includes a pin 62 at its lower end. The pin 62 rides within the slot 52, the hammer release 60 being biased upwardly by a spring 63 toward the top of the hammer guide 53. The hammer release 60 may be moved downwardly against the bias of the spring 63 such that the top of the hammer release 60 clears the hammer guide 53. The trigger 32 is urged in a counter clockwise direction as viewed in FIG. 2 about the pin 46 by means of a spring 70**. When so rotated to the position seen in FIG.

2, the hammer release 60 is urged upwardly into the hammer guide 53 when the hammer 36 is withdrawn to the left.

At the end of the hammer guide 53 opposite the recess 58 is disposed a firing pin 64. The firing pin 64 includes a enlarged portion adapted to the impacted by the hammer 36 and a reduced portion extending through a breech block 66. The range of travel of the firing pin 64 is such that the end of the reduced portion may move from a first position flush with the exterior surface of the block 66 to a second position extended slightly beyond the exterior surface.

The breech lock 34 is pivotally fixed at the top of the block 66 by means of a pin 67. The breech lock 34 includes a lever 68, a paw 68*a* and a spring 68*b*. The spring 68*b* biases the lever 68 and paw 68*a* about the pin 67 such that the paw 68*a* is adapted to engage a groove 69 to thereby hold the breech 14 against the block 66.

The line release 30 is pivoted about a pivot 72 and is biased in a clockwise direction as seen in FIG. 2 by means of a spring 74. The line release 30 includes a groove 76 for receiving a connecting rod 78. The rod 78 is connected to the trigger 32 just above the indentation 48 and is moveable with the trigger 32.

Figure 3:
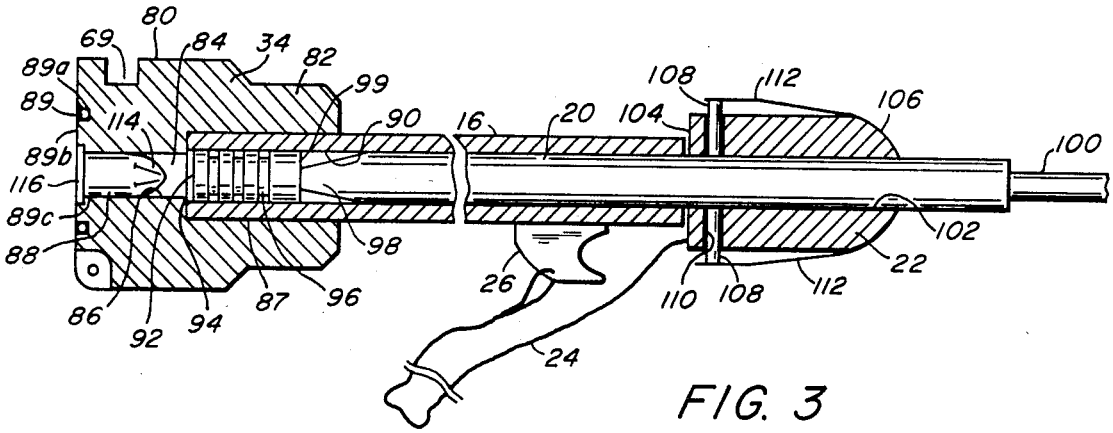
FIG. 3 is a view of the breech, barrel and line retainer of the spear gun of FIG. 1 shown in partial cutaway.

With reference to FIG. 3, the breech includes an enlarged section 80 which tapers into a reduced section 82. A central bore 84 is formed through the enlarged and reduced sections 80 and 82, the central bore in turn consisting of a power load chamber 86 and a barrel receiving portion 87 coaxially aligned with the chamber 86. The chamber 86 is adapted to receive a power load 88 in accordance with the present invention and as is described more fully hereinbelow. An O-ring 89 is concentrically aligned with the chamber 86 and is received within a groove 89*a* formed in an end surface 89*b* of the breech 34.

The barrel receiving portion 87 is threaded (not shown) and receives and retains a suitably threaded end of the barrel 16. In the embodiment disclosed herein, the barrel is about eighteen inches long and is manufactured of type 316 stainless steel tubing. The inside wall of the barrel 16 defines a bore 90. The spear 20 has an outside diameter sized to substantially prevent the flow of gas between the spear 20 and the bore 90. The spear 20 may have an outside diameter about 0.005 inch to 0.030 inch less than the inside diameter of the bore 90, and in the particular embodiment disclosed herein, a difference of 0.010 inch between the spear 20 outside diameter and the bore 90 inside diameter is used. The spear 20 includes an end 92 adapted to be received within the bore 90 and to rest against an annular shoulder 94 formed between the chamber 86 and barrel receiving portion 87. Proximate the end 92 are a plurality of circumferential grooves 96 formed about the spear 20. The spear 20 further includes a tapered section 98 tapering from the outside diameter of the spear 20 toward the end 92 to a smaller diameter cross section defining an annular surface 99 proximate the grooves 96. A second end 100 of the spear may be threaded (not shown) to receive various tips, such as the pointed spear tip shown in FIG. 1.

The line retainer 22 includes an inner bore 102 which slidably receives the spear 20. The retainer 22 may include a flat stop surface 104 at one and a rounded tip 106 at a second end. A plurality of pins 108 are carried in radial bores 110 disposed about the inner bore 102. The pins 108 are urged toward the spear 20 by means of leaf springs 112, each of the springs 112 being fixed at one end to the line retainer 22 near the rounded tip 106. In the embodiment disclosed herein, two pins 108 are used in the line retainer 22.

Figure 5:
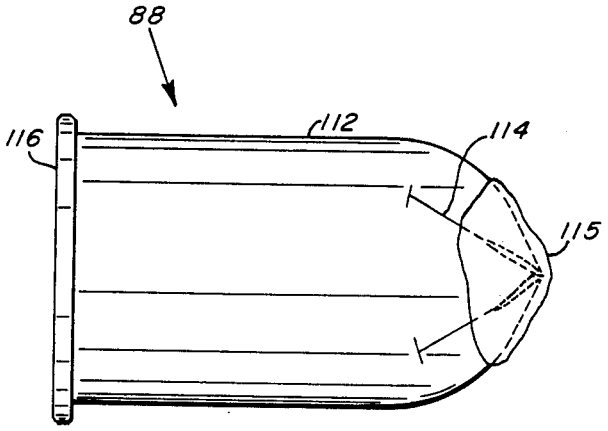
FIG. 5 is a side view of the power load of FIG. 2 in accordance with the present invention.

With reference to FIG. 5, the power load 88 of the present invention includes a casing 112 filled with an explosive charge and a crimped end 114 to retain such charge. The crimped end 114 is coated with a sealing compound 115 such as silicone rubber to seal the power load 88 from water. The power load 88 also includes a flanged end 116 which includes a rim-fire primer for igniting the charge within the power load 88. In the embodiment disclosed herein, the power load 88 is fabricated from an explosive charge used in the construction trades to power fastener drivers such as a power hammer available from Remington, with the end 114 coated with a low viscosity room temperature vulcanizing (RTV) silicone rubber. The explosive charges just described for use in the construction trades are available in twelve power ranges, namely, power ranges one through twelve.

The power load of the present invention, more particularly, is fabricated using explosive charges selected from power ranges one through four as used in the construction trades, and preferably for the enbodiment of the power load shown in FIG. 5, from power ranges two and three. To seal the power load 88, the power load 88 is brushed with, for example, a commercial powered wire brush to remove dirt, oil and other matter from the crimped end of the power load 88. A plurality of the power loads 88 so prepared are grouped together in a rack or other suitable carrier and suspended with the crimped end directed downwardly within an airtight chamber. The rack or carrier includes means such as a mechanism or motor for raising the plurality of power loads 88 within the airtight chamber.

A dish of coating material is placed beneath the power loads 88 with the power loads 88 suspended above the dish.

The chamber is sealed and partially evacuated to a vacuum of approximately ten to thirteen pounds per square inch absolute to remove some residual air from the power loads 88. The power loads are then lowered into the coating material to completely immerse the crimped end 114 of all of the power loads 88 therein and the vacuum is released. The coating material, under the influence of the air pressure returning to the chamber, forces the coating material into the crimped end 114 of the power loads 88, permeating the crimped end 114 to provide a complete and durable seal. The rack is raised to remove the tips of the power loads 88 from the coating material and the coating material is allowed to dry or cure.

Figure 7:
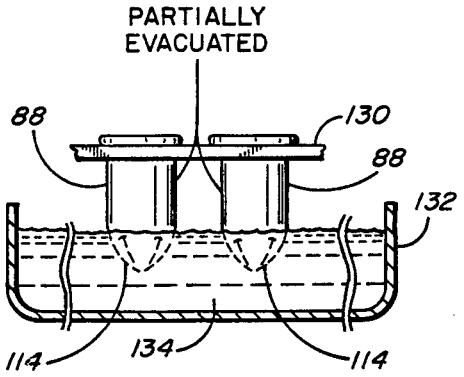
FIG. 7 illustrates a sealing compound coating technique in accordance with the present invention.

FIG. 7 illustrates the crimped ends 114 of partially evacuated power loads 88 suspended by a rack 130 within a dish 132 of coating material 134 immediately prior to the release of the vacuum as just described.

Figure 6:
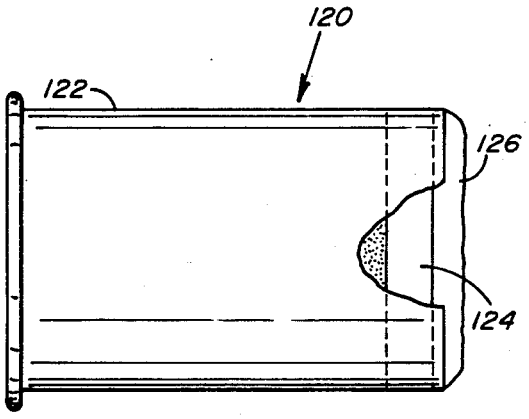
FIG. 6 is an altervative embodiment of the power load of FIG. 5.

Power loads in accordance with the present invention may also be fabricated using explosive charges of a power setting four as available in the construction trades. As seen with reference to the embodiment of the present invention shown in FIG. 6, such a power load 120 is similar to the power load 88 but is not crimped. Instead, the explosive material within a casing 122 is retained by a recessed wad or plug 124 of a suitable material such as cardboard, heavy paper, or plastic that is pressed into place. To seal the power load 120, the power load 120 is arranged in a vertical position with the wad or plug 124 directed upwardly. A small volume of coating material 126, for example about 5 to 20 ul, is placed into the upper end of the power load 120 directly on top of the wad or plug 124. The power load 120 is retained in this position until the coating material has dried or cured.

The coating material must be compatible with salt water and brass, the casing material typically used in commercially available cartridges. The coating material must flow freely and be self-leveling when in a liquid state and must cure without significant shrinkage. To prevent water penetration into the power loads 88 or 120, the coating material must have low water vapor permeability and should not expand or contract significantly when subjected to variations in temperature. Preferably, the coating material should remain slightly flexible and should be compatible with salt water. Two coating materials meeting these requirements are room temperature vulcanizing silicone rubber type 118 and polyvinylchloride dissolved in a mixture of suitable solvents.

In use, the spear gun 10 is easily and safely loaded with the power load of the present invention yet provides considerable range and reliability. To load the gun 10, the breech lock 34 is rotated about the pin 67 to disengage the paw 68*a* from the groove 69. The breech 14 and barrel 16 are rotated about the hinge 18 to expose the chamber 86. The end 92 of the spear 20 is inserted into the barrel 16, coming to rest against the shoulder 94. The power load 88 is inserted into the chamber 86, the flanged end 116 of the power load 88 being received within the annular groove 89*a*. The breech 14 and barrel 16 are then rotated about the hinge 18 to close the end surface against the breech block 66, the O-ring 89*a* providing a seal between the breech 14 and the breech block 66.

The hammer 36 is drawn out of the body 12 by grasping and pulling the bar 54 until the hammer 36 is past the hammer release 60. The hammer release 60 then moves upwardly into the hammer guide 53. The hammer may then be released and is urged against the hammer release 60 by the spring 56. The line release 30 is rotated about the pin 72 in a clock-wise direction until the rod 78 engages the groove 76, locking the line release 30 in place. The line 24 may then be wound between the hook 26 and line release 30, thus holding the line 24 in place and urging the line retainer 22 against the end of the barrel 16. As so configured, the gun 10 is ready to be fired.

To fire the gun, the trigger 32 is rotated about the pin 44, releasing the line release 30 and drawing the hammer release 60 downwardly. Once the hammer release 60 is moved out of the way of the hammer 36, the hammer 36, under the urging of the spring 56, slides rapidly along the hammer guide 53. The flat cross-section of the hammer 36 is compared to the larger cross-sectional area of the recess 58 allows water displaced by the hammer 36 during its movement to be easily moved aside, thus not impeding the movement of the hammer 36. The hammer 36 strikes the firing pin 64 which in turn strikes the flanged end 116 of the power load 88. The rim primer within the power load 88 ignites, causing the explosive within the power load to detonate and producing an explosion which opens the crimped end 114 of the power load 88. A large volume of rapidly expanding gas produced by the power load 88 pushes against the end 92 of the spear 20 and accelerates the spear 20 down the barrerl 16, the grooves 96 serving as a series of pressure interruptors or dynamic seals to interfere with the inhibit the escape of the expanding gases within the barrel 16.

As the now rapidly moving spear 20 exits the barrel, the pins 108 carried by the line retainer 22 are urged along the tapered section 98 by the leaf springs 112, causing the pins to engage the annular surface 99. With the pins 108 so engaged, the line retainer travels with the spear 20, playing out the line 24 as the spear moves through the water.

The spear may be recovered by pulling in the line 24. To reload the gun 10, the breech lock 34 is rotated to release the breech 14 and barrel 16 and both are rotated about the hinge 18. The end 92 of the spear 20 is fitted into the end of the barrel 16 and pushed toward the breech 14, popping the spent power load 88 from the chamber 86. Once the flat stop surface 104 of the line retainer 22 contacts the end of the barrel, the pins 108 ride up the tapered section 98 against the bias of the leaf springs 112 and ride along the spear 20 until the spear is against the shoulder 94. The gun may then be reloaded and prepared as described above for another firing.

The spear gun when used with the power load of the present invention is easily and rapidly reloaded underwater. Furthermore, the power load imparts considerable velocity to the spear. The power load of the present invention provides a compact yet powerful propulsion means that can withstand the rigors of underwater usage, particularly in a salt water environment. The power load does not have a projectile as with conventional firearm cartridges that could damage the internal structure or spear of the spear gun described herein yet is watertight to prevent failure of the explosive material within the power load and the resulting misfires.

The present invention is not be be limited by the above detailed description but shall be given the full scope of the appended claims and all equivalents thereof.

I claim:

1. A method of sealing a power load for use with an underwater spear gun wherein the power load has a crimped end, the method including partially evacuating the power load, dipping the partially evacuated power load into a sealing compound, and forcing the sealing compound into the crimped end under atmospheric pressure.

2. A method of sealing a power load for use with an underwater spear gun wherein the power load has a crimped end, the method including the steps of applying sealing compound to the crimped end and forcing the sealing compound into the power load by a pressure differential between the interior and exterior of the power load.

* * * * *